US008721042B2

(12) United States Patent
Petruchik et al.

(10) Patent No.: US 8,721,042 B2
(45) Date of Patent: May 13, 2014

(54) INKJET PRINTHEAD WITH LAYERED CERAMIC MOUNTING SUBSTRATE

(75) Inventors: Dwight J. Petruchik, Honeoye Falls, NY (US); Mario J. Ciminelli, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 364 days.

(21) Appl. No.: 13/191,492

(22) Filed: Jul. 27, 2011

(65) Prior Publication Data

US 2013/0027466 A1 Jan. 31, 2013

(51) Int. Cl.
*B41J 2/145* (2006.01)

(52) U.S. Cl.
USPC ..... 347/40; 347/71

(58) Field of Classification Search
USPC ..... 347/20–21, 40, 42–44, 49, 65–71, 347/84–85
See application file for complete search history.

(56) References Cited

U.S. PATENT DOCUMENTS

| | | | | |
|---|---|---|---|---|
| 5,646,658 | A * | 7/1997 | Thiel et al. | 347/49 |
| 6,070,965 | A | 6/2000 | Fujimoto | |
| 6,322,206 | B1 | 11/2001 | Boyd et al. | |
| 6,367,911 | B1 * | 4/2002 | Windel et al. | 347/40 |
| 2008/0149024 | A1 | 6/2008 | Petruchik et al. | |
| 2009/0009559 | A1 | 1/2009 | Jindai et al. | |
| 2009/0179965 | A1 | 7/2009 | Hirosawa et al. | |

* cited by examiner

*Primary Examiner* — Thinh Nguyen
(74) *Attorney, Agent, or Firm* — Peyton C. Watkins

(57) ABSTRACT

An inkjet printhead includes a printhead die including: a first nozzle array that is configured to be fed with ink by a first ink feed; and a second nozzle array that is configured to be fed with ink by a second ink feed; and a mounting substrate including: a surface to which the printhead die is attached; a first layer including a first ink channel having an opening disposed at the surface; a second layer including a second ink channel having an opening disposed at the surface; and a third layer disposed between the first layer and the second layer, wherein the printhead die is attached to the first layer, the second layer and the third layer, and wherein the first ink channel opening is fluidically connected to the first ink feed, and the second ink channel opening is fluidically connected to the second ink feed.

19 Claims, 13 Drawing Sheets

INKJET PRINTHEAD WITH LAYERED CERAMIC MOUNTING SUBSTRATE

CROSS REFERENCE TO RELATED APPLICATIONS

Reference is made to commonly assigned and concurrently filed U.S. patent application Ser. No. 13/191,495, filed Jul. 27, 2011 by Dwight Petruchik et al., entitled "Method of Fabricating a Layered Ceramic Substrate", the disclosure of which is herein incorporated by reference.

FIELD OF THE INVENTION

The present invention relates generally to a fluid ejection assembly, such as an inkjet printhead, that includes a mounting substrate for a fluid ejection device, and more particularly to a mounting substrate having closely spaced fluid passageways.

BACKGROUND OF THE INVENTION

Inkjet printing has become a pervasive printing technology. Inkjet printing systems include one or more arrays of drop ejectors provided on an inkjet printing device, in which each drop ejector is actuated at times and locations where it is required to deposit a dot of ink on the recording medium to print the image. A drop ejector includes a pressurization chamber, a drop forming mechanism (e.g. a heater or a piezoelectric structure) and a nozzle. An inkjet printing device is an example of a fluid ejection device. Typically, inkjet printing devices or fluid ejection devices are fabricated as a plurality of die on a wafer. One or more die are then fluidically connected to a mounting substrate as part of the fluid ejection assembly, such as an inkjet printhead.

One way to reduce the cost of an inkjet printhead is to reduce the size of the fluid ejection device, i.e. the printhead die, which typically includes not only the fluid inlets and the arrays of drop ejectors, but also includes logic and switching electronics, as well as electrical interconnections. Due to advances in microelectronic fabrication processes, making the electronics on the die fit within a smaller space is now possible, so that the fluid inlets on the printhead die can be spaced as close together as 0.8 mm center-to-center or closer. The problem that remains is providing a mounting substrate having a die-attach portion with multiple fluid feed slots at the same spacing as the fluid inlet spacing on the printhead die.

Commonly assigned US Published Application No. 2008/0149024 (incorporated herein by reference) discloses a printhead substrate arrangement in which the portion of the substrate that includes the fluid feed slots or channels is made from a ceramic material, while the remaining portion of the substrate arrangement is made by insert molding, i.e. by molding plastic material around the ceramic portion. This arrangement provides for a ceramic mounting surface that is flat and stable and that has a coefficient of thermal expansion that is similar to that of the printhead die in order to facilitate low stress in the printhead die in the assembled printhead. However, the minimum slot to slot pitches typically achieved in a ceramic part made by a low cost powder compaction or dry press process, as might typically have been used to form the ceramic portion of the substrate in US Published Application No. 2008/0149024, are about 1.5 mm (0.7 mm wide slots with 0.8 mm thick walls).

What is needed is a mounting substrate where the widths of the fluid feed slots and the lands between the fluid feed slots are reduced to enable the overall reduction in the size of the corresponding printhead die to be attached. It is further desirable to have a mounting substrate that is low cost.

SUMMARY OF THE INVENTION

An inkjet printhead comprising: a printhead die comprising: a first nozzle array that is configured to be fed with ink by a first ink feed; and a second nozzle array that is configured to be fed with ink by a second ink feed; and a mounting substrate including: a surface to which the printhead die is attached; a first layer including a first ink channel having an opening disposed at the surface; a second layer including a second ink channel having an opening disposed at the surface; and a third layer disposed between the first layer and the second layer, wherein the printhead die is attached to the first layer, the second layer and the third layer, and wherein the first ink channel opening is fluidically connected to the first ink feed, and the second ink channel opening is fluidically connected to the second ink feed.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
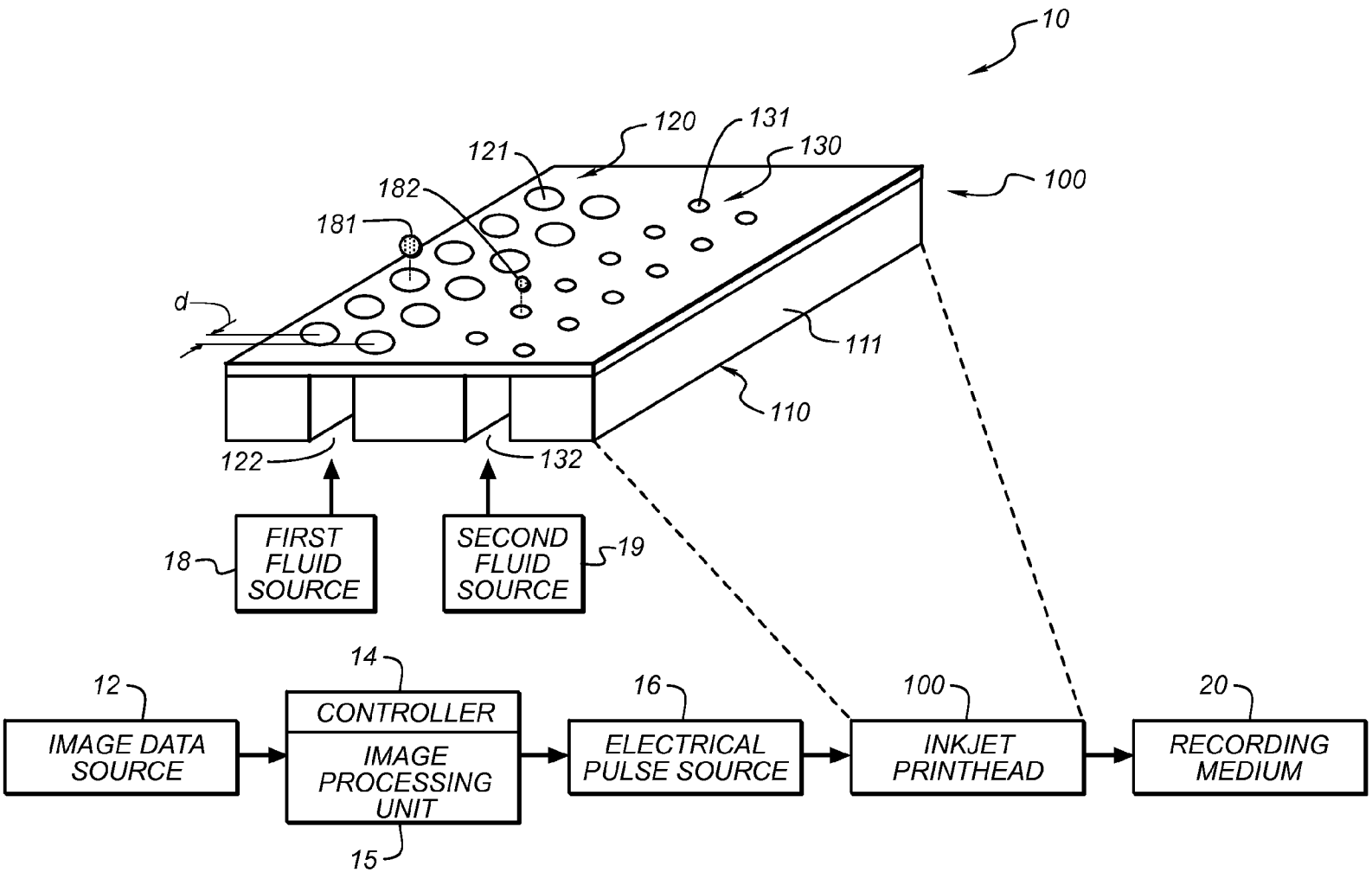
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a mounting substrate having ink channels for providing ink to the printhead die as discussed below. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms and pressurization chambers associated with the nozzles to form an array of drop ejectors corresponding to the nozzle array. Drop forming mechanisms can be of a variety of types, some of which include a resistive heater to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
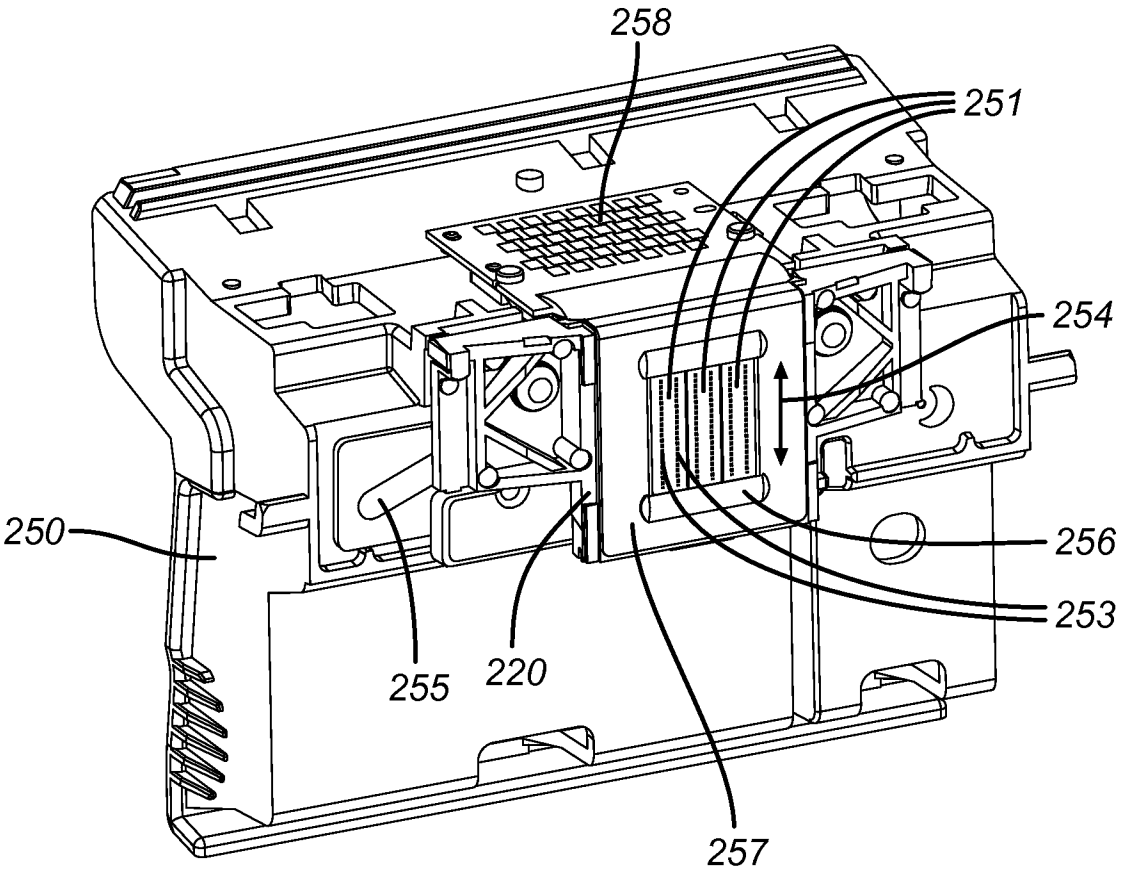
FIG. 2 is a perspective view of a portion of a printhead.

FIG. 2 shows a perspective view of a portion of a printhead 250, which is an example of an inkjet printhead 100 suitable for use in a carriage printer. Printhead 250 includes three printhead die 251 (similar to printhead die 110 in FIG. 1), each printhead die 251 containing two nozzle arrays 253, so that printhead 250 contains six nozzle arrays 253 altogether. The three printhead die 251 are affixed to a mounting substrate 220 for support and for fluidic connection to ink supplies. An ink manifold 255 includes ink passageways (not shown) that bring the ink from the comparatively widely spaced ink sources to the more narrowly spaced nozzle arrays. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

Figure 3:
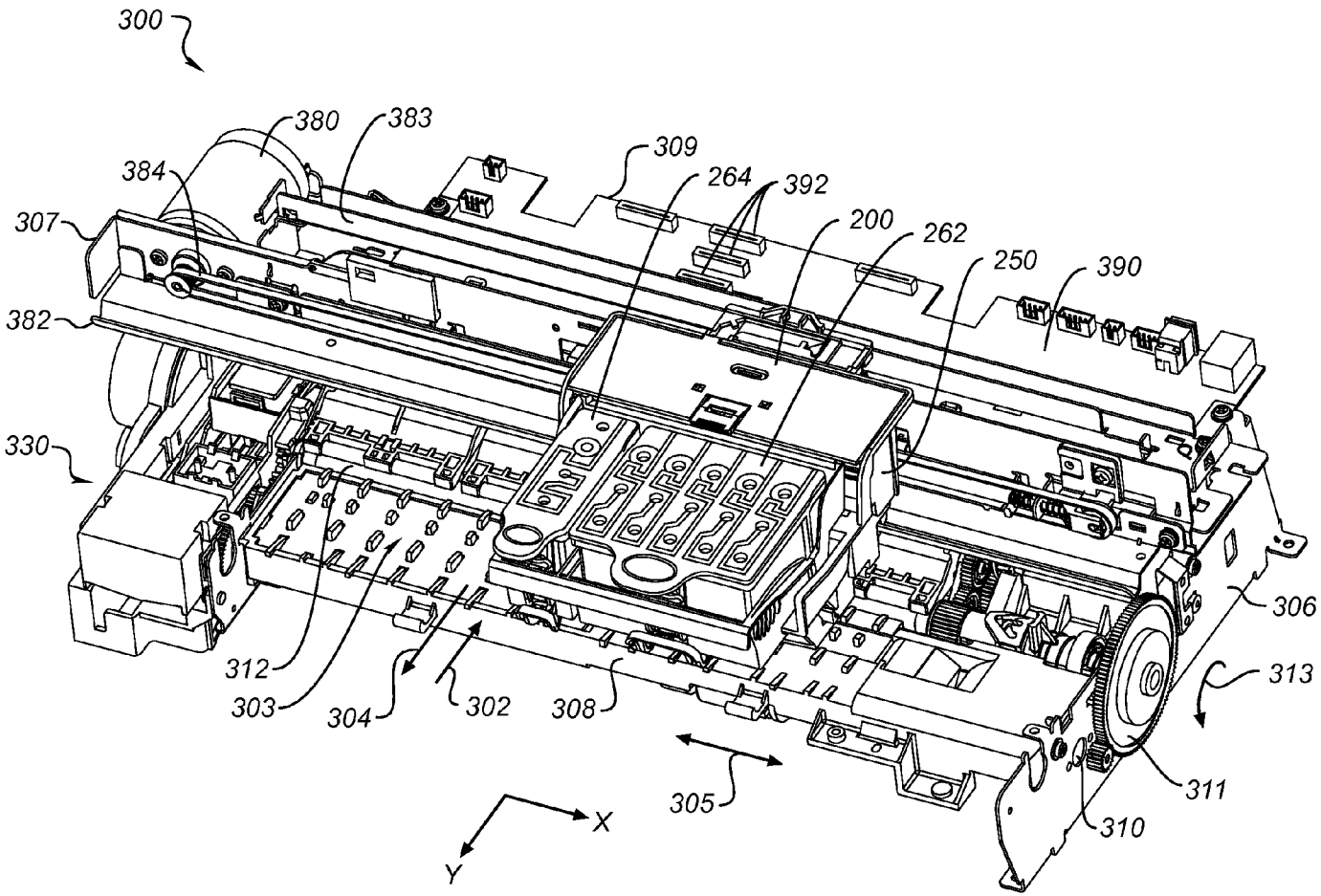
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from nozzle arrays 253 on printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink supply 262 and single-chamber ink supply 264 are mounted in the printhead 250. The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 4:
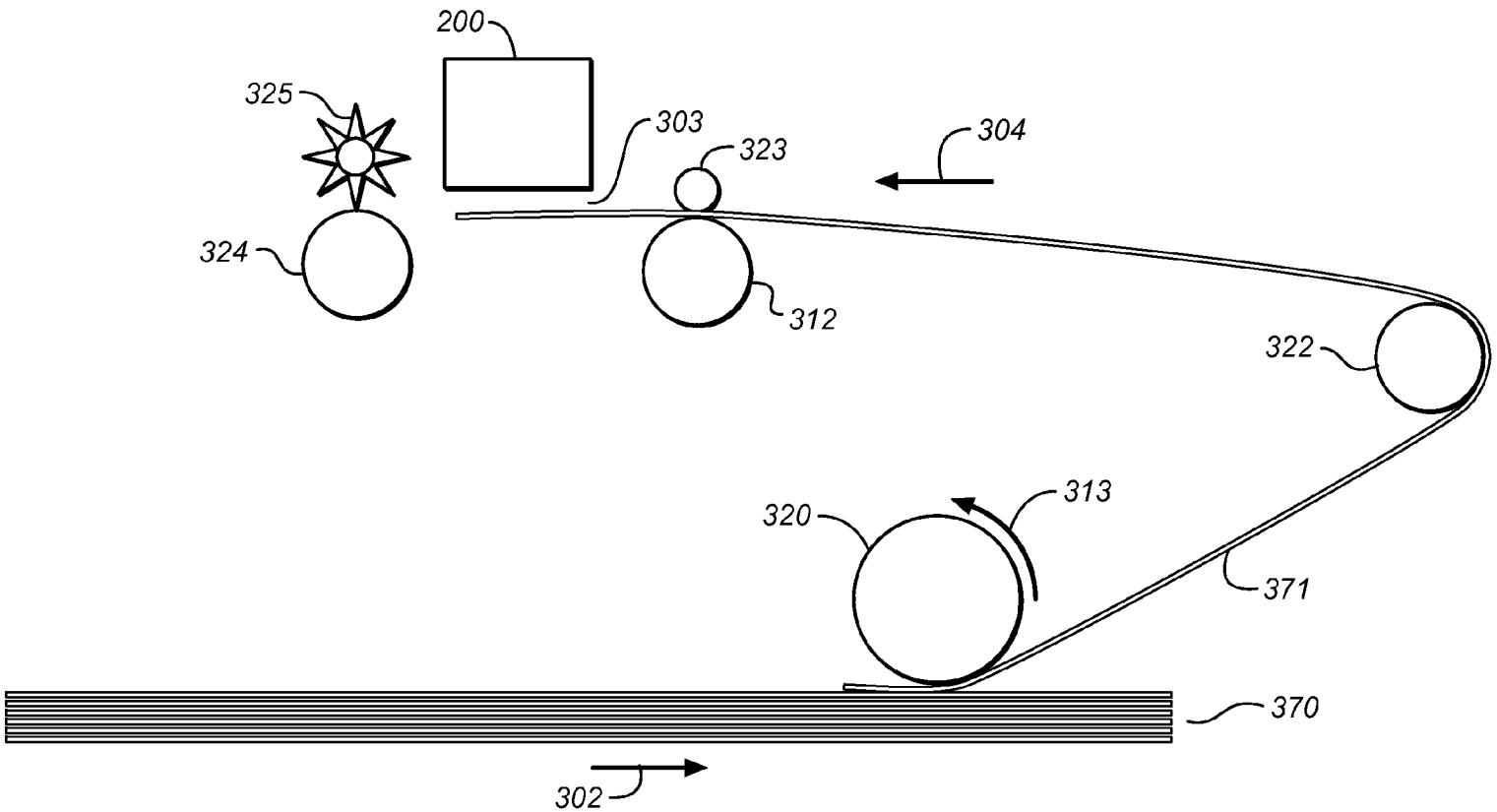
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303 located near the nozzle arrays of the printhead, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
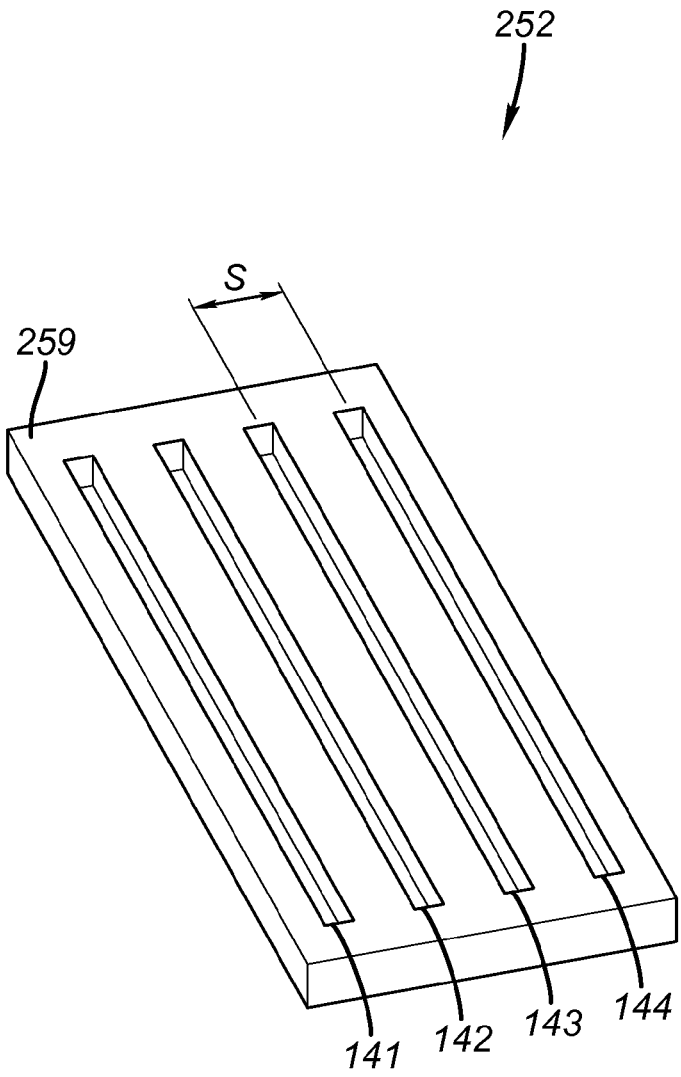
FIG. 5 is a backside view of a printhead die including ink feeds.

FIG. 5 shows the bonding surface 259 on the back side of a printhead die 252 that has four ink feeds (configured as ink inlet slots) 141, 142, 143 and 144 corresponding to first, second, third and fourth drop ejector arrays (that are located on the opposite side of printhead die 252) respectively. Drop ejector arrays and associated logic and switching electronics are located between ink feeds, as well as beyond the outside ink feeds 141 and 144. Compact design and fabrication of the electronics on printhead die 252 allows the center-to-center spacing "s" between adjacent ink feeds to be less than one millimeter, for example 0.8 mm.

Figure 6:
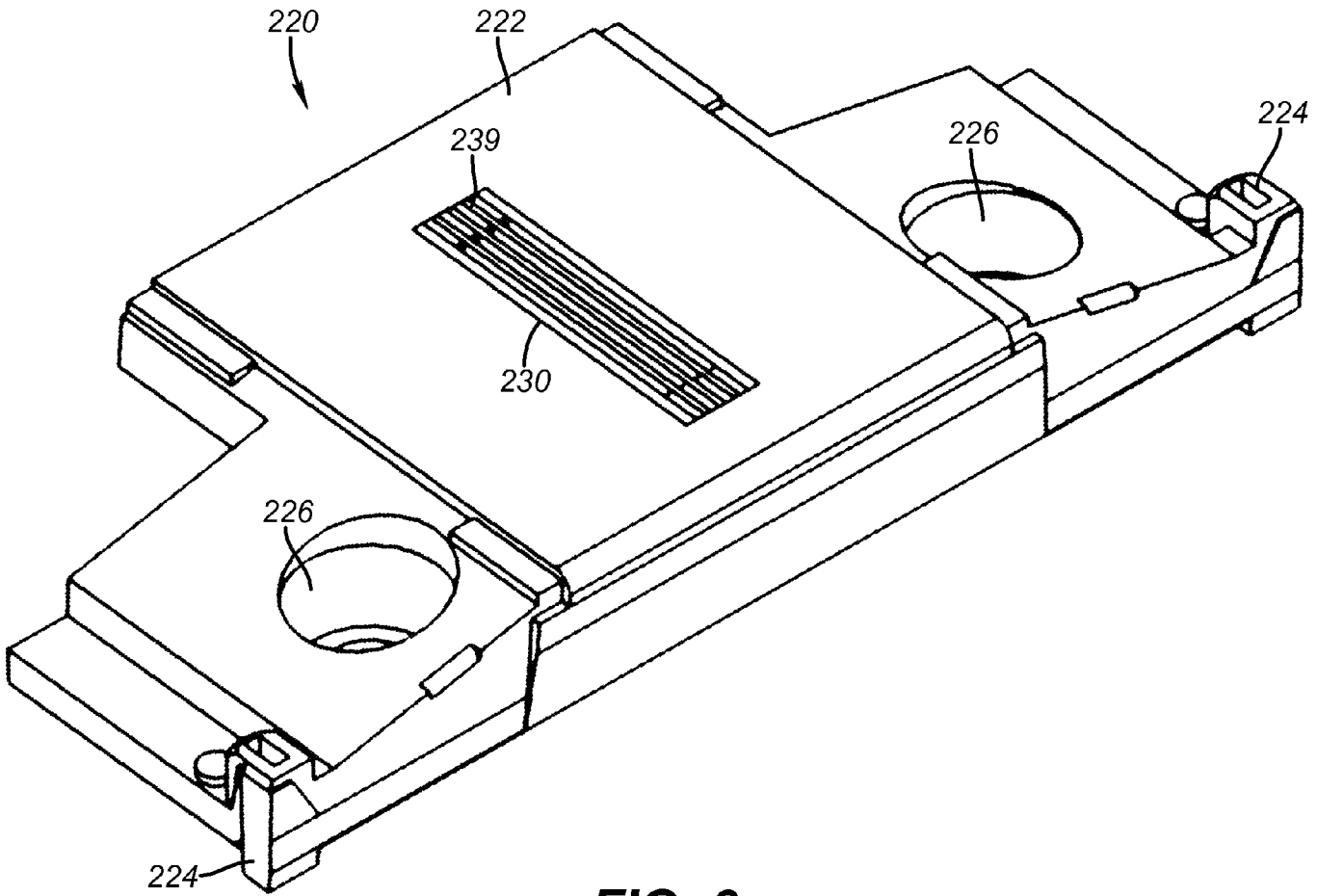
FIG. 6 is a perspective view of a mounting substrate according to an embodiment of the invention.

FIG. 6 shows a perspective view of a mounting substrate 220 according to an embodiment of the present invention. Mounting substrate 220 includes a plastic housing portion 222 that extends outwardly from a die-attach portion 230 (typically ceramic). Housing portion 222 includes alignment features 224 and bolt hole 226, and is generally similar to the first portion of the substrate described in US Published Application No. 2008/0149024. Die-attach portion 230 includes a set of ink channels 231, 232, 233 and 234 in order to accommodate one four-nozzle-array printhead die 252 of the type shown in FIG. 5 or two two-nozzle-array printhead die 251 of the type shown in FIG. 2. The ink channels 231, 232, 233 and 234 (FIG. 7) are fluid passageways (described below) that terminate respectively at openings 235, 236, 237 and 238 at the die-attach surface 239 of die-attach portion 230. The openings 235, 236, 237 and 238 at the die-attach surface 239 are spaced at the same center-to-center spacing "s" as in printhead die 252 of FIG. 5, for example 0.8 mm. When printhead die 251 or 252 are subsequently mounted on mounting substrate 220, it is the die-attach surface 239 to which the printhead die are bonded. In addition a fluidic connection is made between each channel opening 235, 236, 237 and 238 and the corresponding ink feeds 141, 142, 143 and 144 on printhead die 252 (FIG. 5). Die-attach portion 230 is analogous to the second portion of the substrate described in US Published Application No. 2008/0149024. Although, as in US Published Application No. 2008/0149024, die-attach portion 230 is made of ceramic, contains ink channels, and is insert molded into housing portion 222 to form mounting substrate 220, it is different from the second portion of the substrate described in US Published Application No. 2008/0149024, because die-attach portion 230 includes a plurality of layers in which the ink channels are formed, as described in further detail below.

Figure 7:
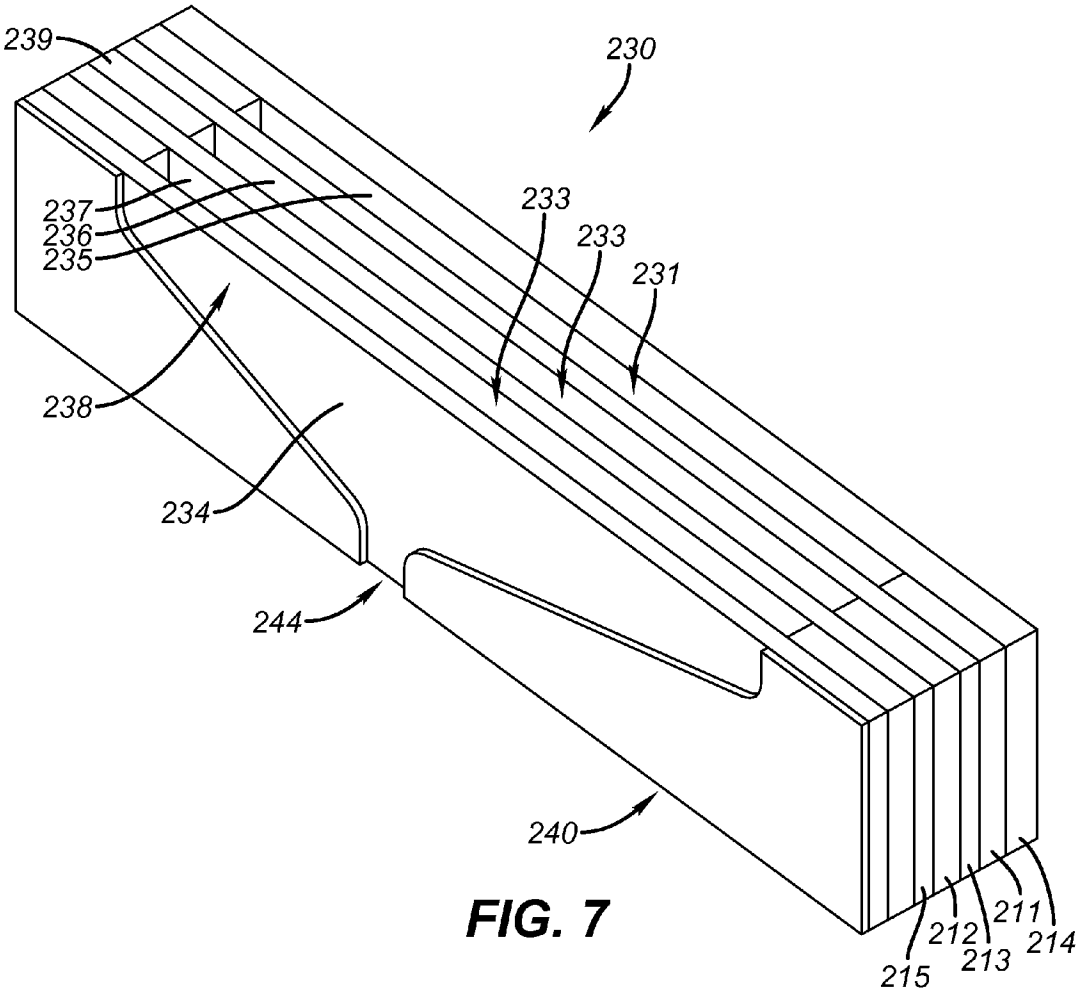
FIG. 7 is a perspective cutaway view of the die-attach portion of a mounting substrate according to an embodiment of the invention.

FIG. 7 shows a perspective cutaway close-up view of the die-attach portion 230 of the mounting substrate according to an embodiment of the present invention. An outer layer of die-attach portion 230 is removed in the view of FIG. 7 in order to show an entire channel 234 that is formed by patterning one of the layers. Channel 234 includes a slot-shaped opening 238 at die-attach surface 239 and progressively narrows to an inlet opening 244 at inlet surface 240 opposite die-attach surface 239. The other channels 231, 232 and 233 similarly include slot-shaped openings 235, 236 and 237 respectively at die-attach surface 239, as well as inlet openings 241, 242 and 243 respectively at the inlet surface 240 (FIG. 10). Each channel in the embodiment shown in FIG. 7 is formed by a patterned layer surrounded by two solid layers as described in further detail relative to FIG. 9. In particular, a first layer 211 is patterned to include channel 231, and a second layer 212 is patterned to include channel 232. A third layer 213 is disposed between first layer 211 and second layer 212. A fourth layer 214 is disposed adjacent first layer 211 on a side opposite third layer 213, and a fifth layer 215 is disposed adjacent second layer 212 on a side opposite third layer 213. Third layer 213, fourth layer 214 and fifth layer 215 do not have an opening at die-attach surface 239 between or around openings 235 and 236, so that a fluidic seal can be made around openings 235 and 236 with no ink leakage. As mentioned above relative to FIG. 6, die-attach portion 230 can subsequently be insert molded as part of a larger mounting substrate including a plastic housing portion 222 that extends outwardly from the die-attach portion 230.

Figure 8:
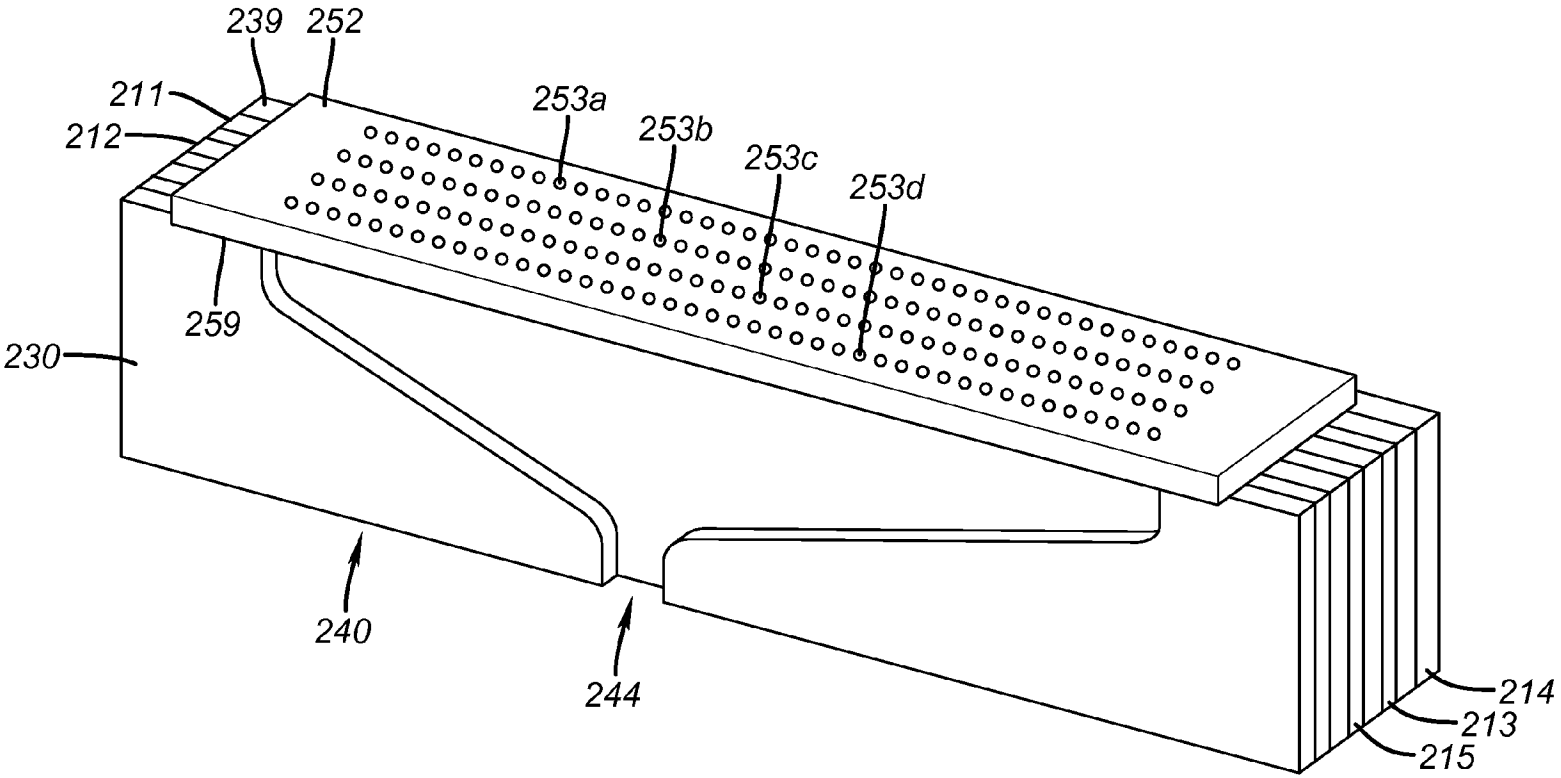
FIG. 8 is a perspective cutaway view similar to FIG. 7, but with a printhead die attached to the die-attach portion.

FIG. 8 shows a view similar to that of FIG. 7, but with the bonding surface 259 of printhead die 252 attached to die-attach portion 230. Printhead die 252 includes four nozzle arrays 253*a*, 253*b*, 253*c* and 253*d* fed by corresponding ink inlets 141, 142, 143 and 144 (FIG. 5). Each of the nozzle arrays is associated with a corresponding array of drop forming elements (such as resistive heaters, or piezoelectric actuators) for ejecting drops of ink through the nozzles. Printhead die 252 is attached (typically with an ink resistant adhesive) to die-attach surface 239. Since first layer 211, second layer 212, third layer 213, fourth layer 214, fifth layer 215 and the other unlabelled layers of die-attach portion 230 all terminate at the die-attach surface 239, printhead die 252 is attached to portions of all of those layers. In addition, ink channel 231 is fluidically connected to ink feed 141, ink channel 232 is fluidically connected to ink feed 142, ink channel 233 is fluidically connected to ink feed 143, and ink channel 234 is fluidically connected to ink feed 144. In order to reduce the cost of multilayer ceramic die-attach portion 230, it is typically made to be not much larger than the area of the printhead die 252. As shown in the example of FIG. 8, typically the area of bonding surface 259 of printhead die 252 is greater than 70% (and preferably greater than 90%) of the area of the die-attach surface 239 of die-attach portion 230.

Multilayer ceramic substrates have been used before in inkjet printheads. U.S. Pat. No. 6,322,206 discloses a multilayer ceramic substrate including both circuitry and ink passageways for the printhead die that are bonded to its surface. However, in U.S. Pat. No. 6,322,206 the layers include overlapping slots such that when the layers are stacked together, ink channels are defined for carrying ink from one side of the substrate to the other. In other words, unlike the present invention where the planes of the layers are perpendicular to the die-attach surface 239, in U.S. Pat. No. 6,322,206 the planes of the layers are parallel to the die-attach surface. As a result, in U.S. Pat. No. 6,322,206 the printhead die are attached to a single top layer, rather than to a plurality of layers of ceramic.

Figure 9A:
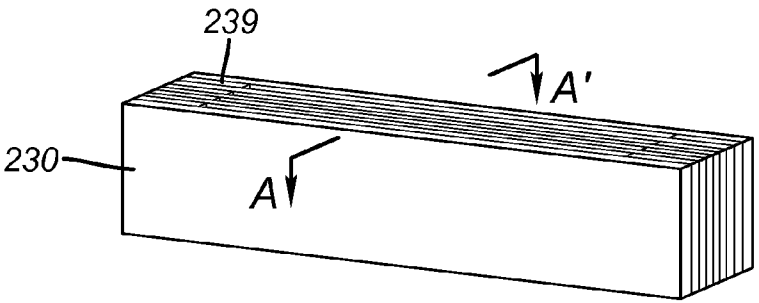
FIGS. 9A and 9B are a perspective view and an exploded view of the die-attach portion and its layers.
Figure 9B:
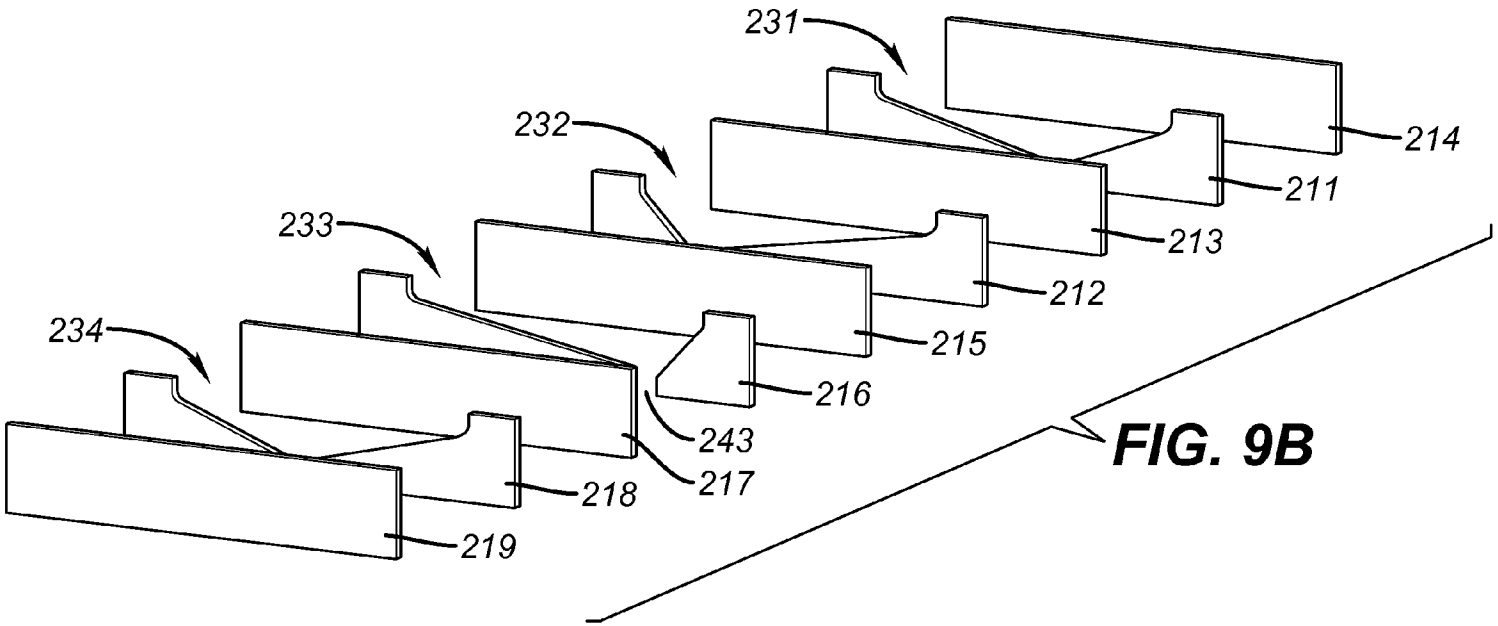
Figure 10:
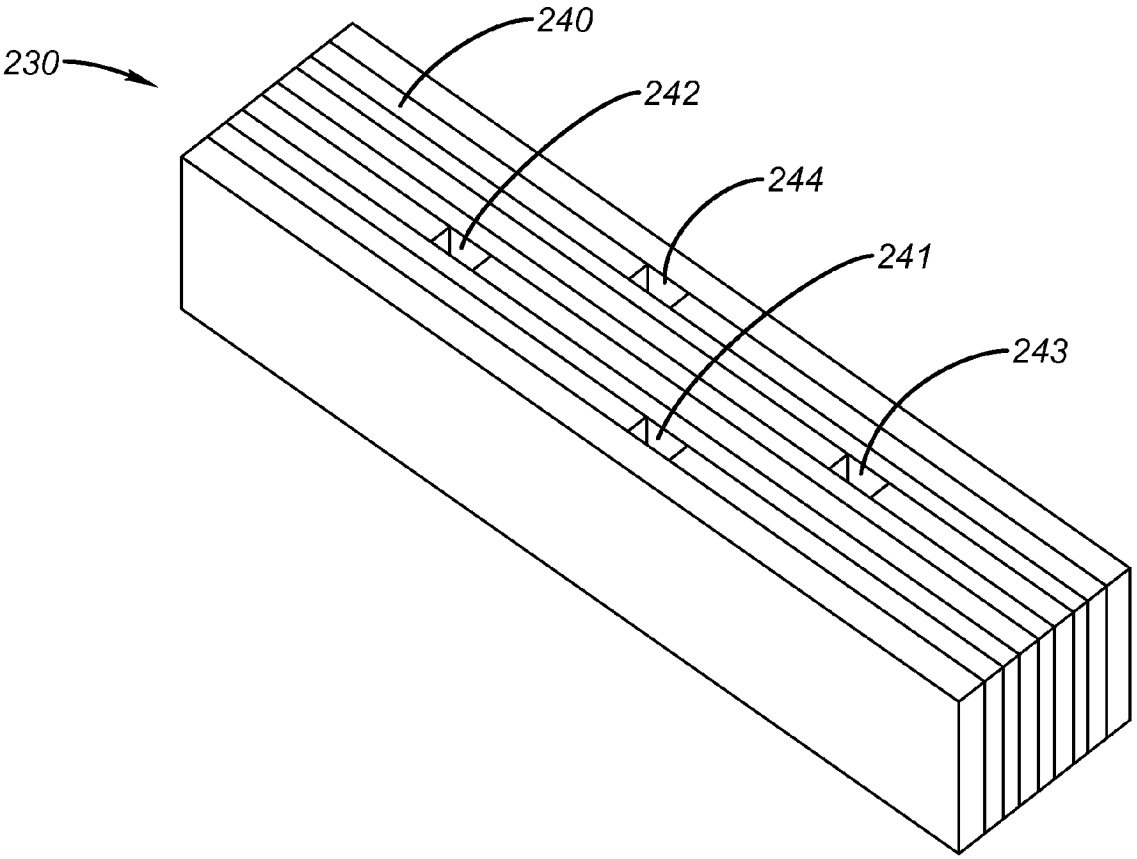
FIG. 10 is a perspective view of an inlet surface side of the die-attach portion.

FIG. 9A shows a perspective view and FIG. 9B shows a corresponding exploded view of die-attach portion 230. In this embodiment, four of the layers (first layer 211, second layer 212, sixth layer 216 and eighth layer 218) are patterned and are alternately spaced with unpatterned layers (fourth layer 214, third layer 213, fifth layer 215, seventh layer 217 and ninth layer 219). Ink channels 231, 232, 233 and 234 can be seen in FIG. 9B, as can inlet opening 243 in sixth layer 216. The ink channels are somewhat asymmetrically shaped so that the inlet openings 241, 242, 243 and 244 (corresponding respectively to first layer 211, second layer 212, sixth layer 216 and eighth layer 218 and fluidically connected respectively to first ink channel 231, second ink channel 232, third ink channel 233 and fourth ink channel 234)) are staggered on inlet surface 240 as shown in FIG. 10. By staggering the relatively small inlet openings in this way, it is possible to make fluidic seals to ink manifold 255 (FIG. 2) by gaskets, thereby providing fluidic connection between a first ink supply and the first ink channel opening 235 and fluidic connection between a second ink supply and the second ink channel opening 236.

Figure 11A:
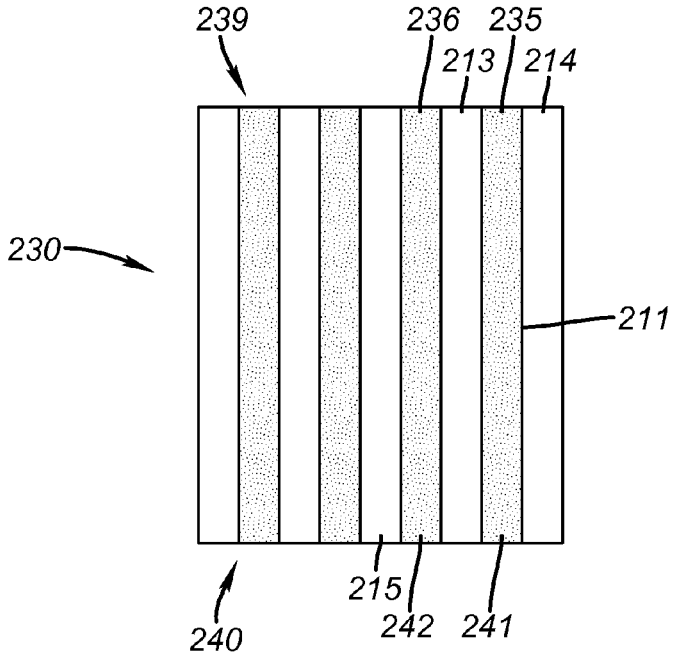
FIG. 11A is a cross-sectional view of an embodiment where each ink channel is formed in a single layer.

For embodiments described above, each ink channel is formed in a single layer of the multilayer substrate, so that the spacing and the widths of the openings at die-attach surface 239 are the same as the spacing and widths of the inlet openings at inlet surface 240 of die-attach portion 230. FIG. 11A shows a cross-section along A-A' of FIG. 9A to show that type of structure, where for simplicity it is assumed that the inlets openings at inlet surface 240 are not staggered as they are in FIG. 10, so that the cross-section goes through all of the inlet openings.

Figure 11B:
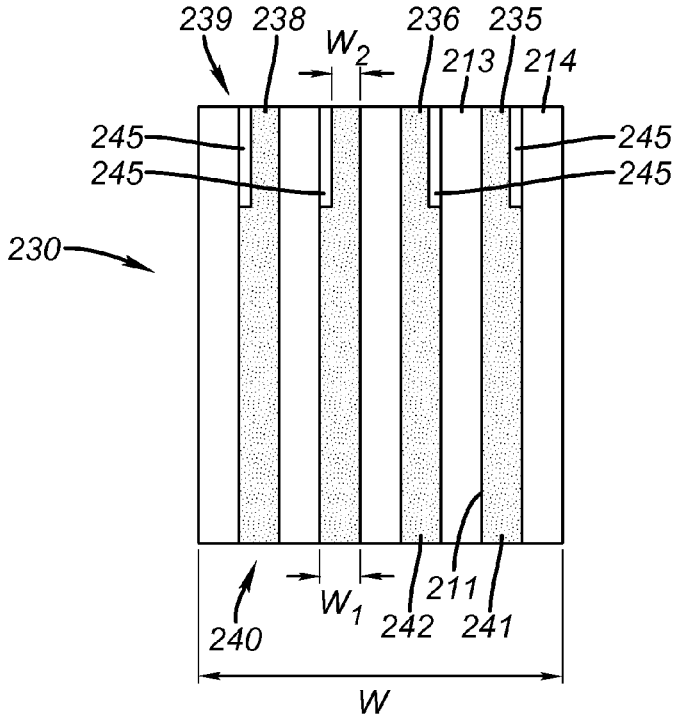
FIG. 11B is a cross-sectional view of an embodiment where each ink channel is formed in a plurality of layers.

FIG. 11B shows a similar cross-sectional view along A-A' of a different embodiment where each channel is formed using a plurality of patterned layers, and where each ink channel is separated by unpatterned layers. In particular, relative to ink channel 235, a supplementary layer 245 is disposed between first layer 211 and fourth layer 214. Supplementary layer 245 is patterned such that first ink channel 236 is included in both first layer 211 and in supplementary layer 245. In this example, a solid portion of supplementary layer 245 remains near die-attach surface 239. As a result, a width $w_1$ of the ink channel near inlet surface 240 is greater than a width $w_2$ of the ink channel near die-attach surface 239. In that way, the fluid impedance and the susceptibility of the ink channel to trap air bubbles is decreased, while providing sufficient fluid seal area on die-attach surface 239 between ink channels for high reliability leak-free seals. In addition, for ink channels such as 235 and 236 toward the right side of die-attach portion 230, the supplementary layers 245 are on the right side of the opening of the ink channel at the die-attach surface 239, while for ink channels such as 238 toward the left side of die-attach portion 230, the supplementary layers 245 are on the left side of the opening of the ink channel at the die-attach surface 239. As a result, along a width direction W of die-attach portion 230, a center-to-center spacing of the openings of the ink channels on the die-attach surface 239 is smaller than a center-to-center spacing of the inlet openings on the inlet surface 240.

Figure 12:
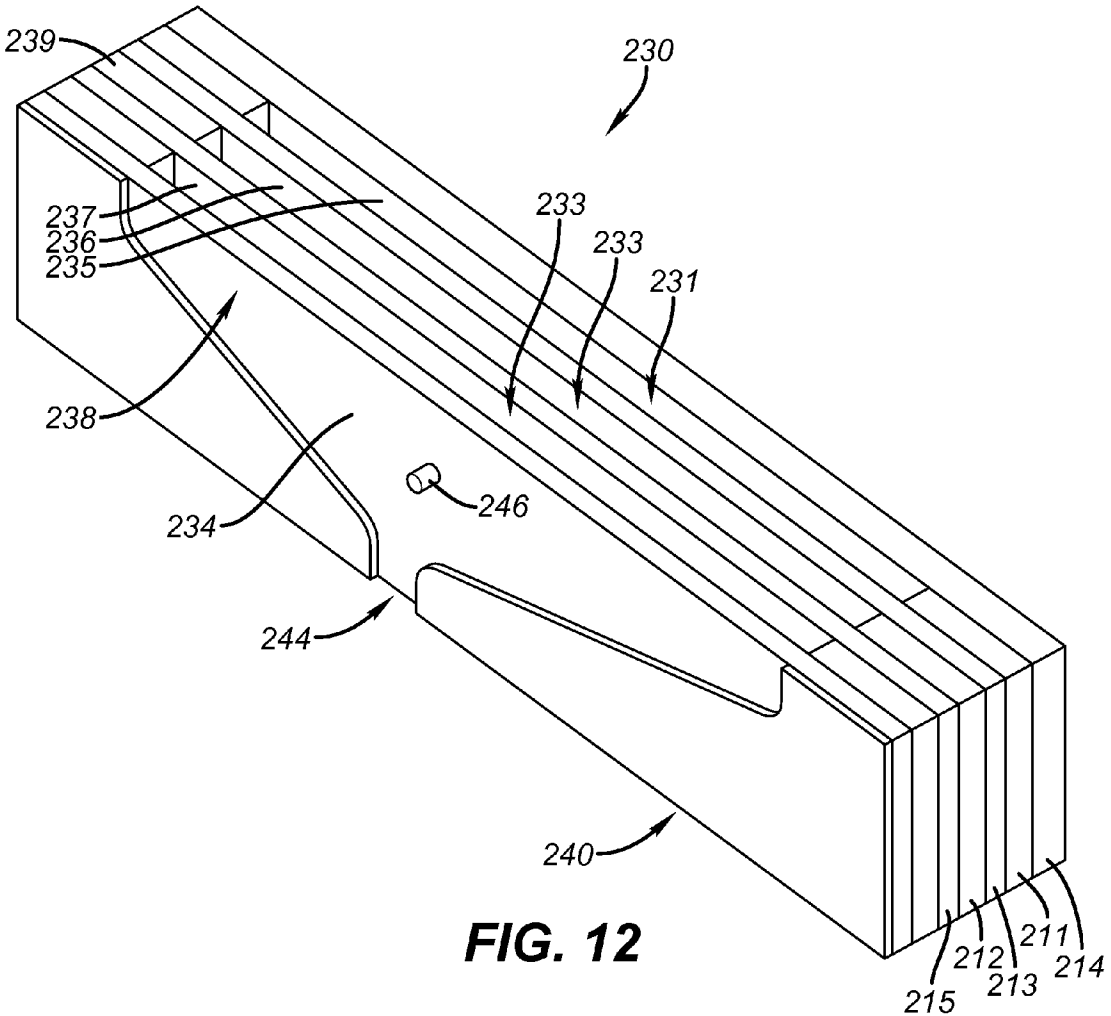
FIG. 12 is a perspective cutaway view of the die-attach portion of a mounting substrate according to an embodiment of the invention including one or more connecting features in each ink channel.

In some embodiments the solid layers such as third layer 213 and fourth layer 214 surrounding patterned first layer 211, or the third layer 213 and the fifth layer 215 surrounding patterned second layer 212 (FIGS. 7 and 9) can be connected to each other by one or more connecting features 246 that are included in the ink channel in the patterned layer, as shown in the cutaway view of FIG. 12. Connecting features 246 can provide mechanical support across the large region of the channel, so that the solid layers do not tend to sag toward each other. In some embodiments, connecting features 246 can function as flow restrictors or flow directors.

Having described embodiments of the mounting substrate, a context has been provided for describing methods of fabricating the mounting substrate. In a preferred embodiment, a plurality of layers of unfired ceramic are provided. At least a first layer and a second layer of the plurality of layers are each patterned to have unfired ceramic disposed in one region and no unfired ceramic in another region. Patterning of the layers can be done for example by tape casting the layers from ceramic slurry or by laser cutting the unfired ceramic. In some embodiments a punching operation can be used to remove material from layers (such as the first layer and the second layer) that include portions of ink channels in order to provide the ink channels. Laser cutting can be preferable if a layer includes connecting features as described above. The plurality of layers are stacked in a predetermined order, typically with at least one unpatterned layer between the first layer and the second layer. The stack of layers is fired to make a co-fired multilayer substrate including a first ink channel through the substrate corresponding to the first layer and a second ink channel through the substrate corresponding to the second layer. A die-attach surface of the mounting substrate is in a plane that is perpendicular to the planes of the layers. The die-attach surface defines a first ink channel opening corresponding to the first layer and a second ink channel opening corresponding the second layer. Because the thickness of each layer can be on the order of 0.4 mm, the center-to-center spacing of the ink channel openings at the die attach surface can be approximately 0.8 mm as required. In order to facilitate a good fluidic seal and good alignment for the printhead die that will later be attached to the mounting substrate, typically the die-attach surface is then flattened by a grinding operation.

Figure 13:
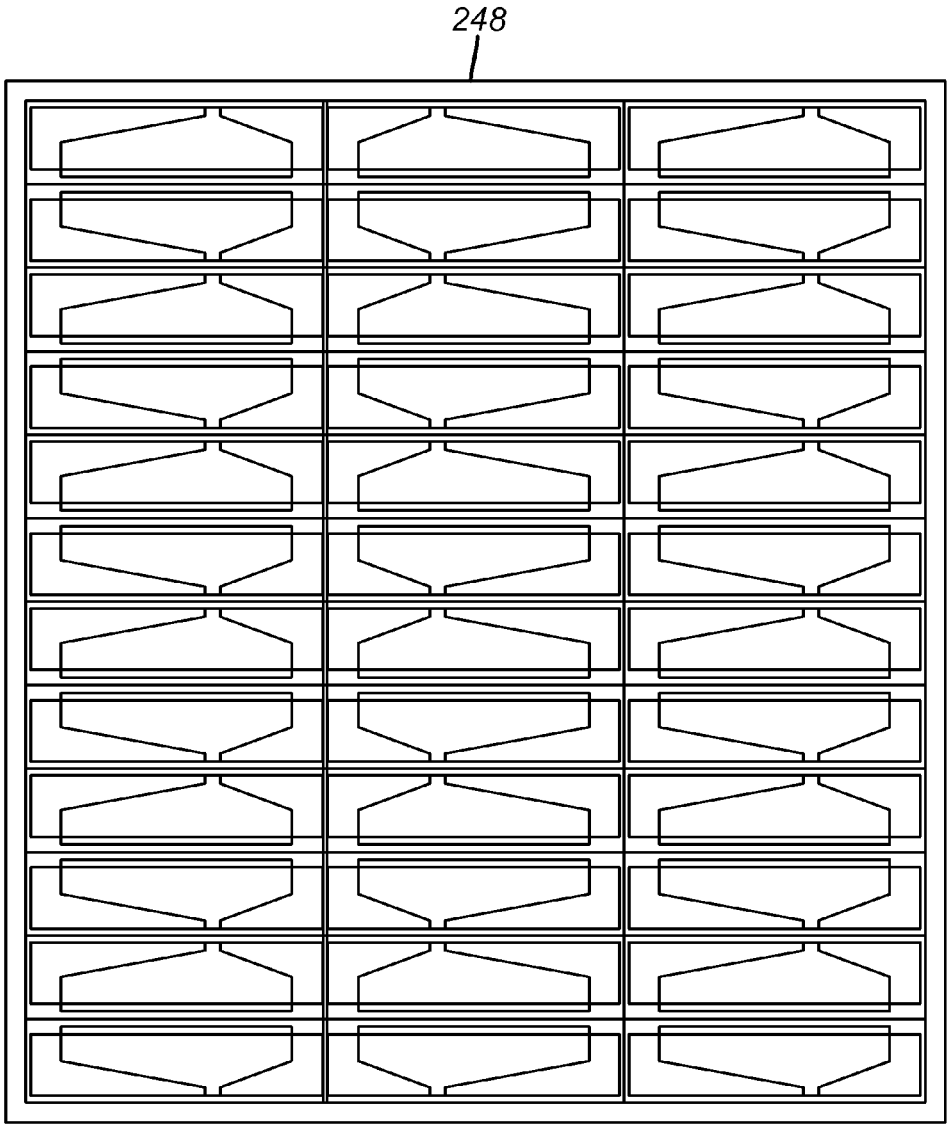
FIG. 13 shows a layer configured as a panel of parts for making multiple parts at the same time.

For economical fabrication, many such co-fired multilayered substrates can be made at the same time. FIG. 13 shows a layer configured as a panel 248 including twelve rows and three columns of patterned parts. Similar panels of patterned and unpatterned parts would be stacked together in a predetermined order and fired. Typically the parts in each panel are substantially identical with each other, although they can be oriented in different orientations. The stacked and fired parts would then be separated, for example by dicing or breaking apart. If the separation operation does not provide a sufficiently flat die-attach surface, the die-attach surface of each part would be ground. Typically the surface prior to grinding would already expose the first ink channel opening and the second ink channel opening. In some embodiments the openings are not exposed until grinding operation exposes them. Also in some embodiments, both the die-attach surface and the inlet surface are ground after the separation operation.

As mentioned above, in order to make mounting substrates in a low cost fashion, typically only the die-attach portion would be fabricated as a multilayer ceramic part. The die-attach portions would then be insert molded together with a plastic housing portion to provide widely spaced alignment features in the mounting substrate.

In order to make a printhead, one or more printhead die, including a first nozzle array and a second nozzle array, is then attached to the die-attach surface of the mounting substrate, so that an ink feed that is configured to feed ink to the first nozzle array is fluidically connected to the first ink channel opening, a second ink feed that is configured to feed ink to the second nozzle array is fluidically connected to the second ink channel opening. Attaching the printhead die is typically done by applying an adhesive to the die-attach surface of the mounting substrate, aligning the printhead die (for example to the alignment features provided in the plastic housing portion), and curing the adhesive. The cured adhesive provides an ink-tight seal that extends around the first ink channel opening and the second ink channel opening.

The invention has been described in detail with particular reference to certain preferred embodiments thereof, but it will be understood that variations and modifications can be effected within the spirit and scope of the invention.

Parts List

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
141 Ink feed
142 Ink feed
143 Ink feed
144 Ink feed
181 Droplet(s) (ejected from first nozzle array)
182 Droplet(s) (ejected from second nozzle array)
200 Carriage
211 First layer
212 Second layer
213 Third layer
214 Fourth layer
215 Fifth layer
216 Sixth layer
217 Seventh layer
218 Eighth layer
219 Ninth layer
220 Mounting substrate
222 Housing portion
224 Alignment feature(s)
226 Bolt hole(s)
230 Die-attach portion
231 Ink channel
232 Ink channel
233 Ink channel
234 Ink channel
235 Opening
236 Opening
237 Opening
238 Opening
239 Die-attach surface
240 Inlet surface
241 Inlet opening
242 Inlet opening
243 Inlet opening
244 Inlet opening
245 Supplementary layer
246 Connecting feature
248 Panel
250 Printhead
251 Printhead die
252 Printhead die
253 Nozzle array
254 Nozzle array direction
255 Ink manifold
256 Encapsulant
257 Flex circuit
258 Connector board
259 Bonding surface
262 Multi-chamber ink supply
264 Single-chamber ink supply
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors

The invention claimed is:

1. An inkjet printhead comprising:
a printhead die including:
a first nozzle array that is configured to be fed with ink by a first ink feed; and
a second nozzle array that is configured to be fed with ink by a second ink feed; and
a mounting substrate including:
a surface to which the printhead die is attached;
a first layer including a first ink channel having an opening disposed at the surface;
a second layer including a second ink channel having an opening disposed at the surface; and
a third layer disposed between the first layer and the second layer, wherein the printhead die is attached to the first layer, the second layer and the third layer, and wherein the first ink channel opening is fluidically connected to the first ink feed, and the second ink channel opening is fluidically connected to the second ink feed;

wherein the surface of the mounting substrate is a first surface, the mounting substrate further including a second surface opposite the first surface, wherein the first layer includes a first inlet opening disposed at the second surface, the first inlet opening being fluidically connected to the first ink channel opening; and wherein the second layer includes a second inlet opening disposed at the second surface, the second inlet opening being fluidically connected to the second ink channel opening.

2. The inkjet printhead of claim 1, wherein the third layer of the mounting substrate does not include an opening disposed at the surface between the first ink channel opening and the second ink channel opening.

3. The inkjet printhead of claim 1, the mounting substrate further including:

a fourth layer disposed adjacent the first layer opposite the third layer; and a fifth layer disposed adjacent the second layer opposite the third layer, wherein the printhead die is further attached to the fourth layer and the fifth layer.

4. The inkjet printhead of claim 3, wherein the first ink channel includes one or more connecting features disposed between the fourth layer and the third layer, and the second ink channel includes one or more connecting features disposed between the fifth layer and the third layer.

5. The inkjet printhead of claim 1, wherein the printhead die further including a supplementary patterned layer adjacent the first layer, wherein a width of an inlet opening of the first ink channel disposed at the second surface is greater than a width of the first ink channel opening at the first surface.

6. The inkjet printhead of claim 1, wherein the printhead die further including:

a first supplementary patterned layer adjacent the first layer; and a second supplementary patterned layer adjacent the second layer, wherein a center-to-center spacing between an inlet opening of the first ink channel and an inlet opening of the second ink channel disposed at the second surface is greater than a center-to-center spacing between the first ink channel opening and the second ink channel opening at the first surface.

7. The inkjet printhead of claim 1, wherein the mounting substrate comprises multilayer co-fired ceramic.

8. The inkjet printhead of claim 7, wherein the co-fired ceramic mounting substrate is insert molded into a plastic member including alignment features for attaching the printhead die.

9. The inkjet printhead of claim 1, the printhead die further including:

a first array of drop forming elements that are configured to eject drops of ink through the first array of nozzles; and a second array of drop forming elements that are configured to eject drops of ink through the second array of nozzles.

10. The inkjet printhead of claim 1, the printhead die including a bonding surface for attachment to a die-attach portion of the mounting substrate, wherein an area of the printhead die at the bonding surface is greater than 70% of an area of the die-attach surface of the die-attach portion.

11. An inkjet printer comprising:

an inkjet printhead comprising:

a printhead die including:

a first nozzle array that is configured to be fed with ink by a first ink feed; and a second nozzle array that is configured to be fed with ink by a second ink feed; and a mounting substrate including:

a surface to which the printhead die is attached;

a first layer including a first ink channel having an opening disposed at the surface;

a second layer including a second ink channel having an opening disposed at the surface; and a third layer disposed between the first layer and the second layer, wherein the printhead die is attached to the first layer, the second layer and the third layer, and wherein the first ink channel opening is fluidically connected to the first ink feed, and the second ink channel opening is fluidically connected to the second ink feed;

a first ink supply that is fluidically connected to the first ink channel opening;

a second ink supply that is fluidically connected to the second ink channel opening; and a media advance system for advancing recording medium into a print region located proximate the first nozzle array and the second nozzle array;

wherein the surface of the mounting substrate is a first surface, the mounting substrate further including a second surface opposite the first surface, wherein the first layer includes a first inlet opening disposed at the second surface, the first inlet opening being fluidically connected to the first ink channel opening; and wherein the second layer includes a second inlet opening disposed at the second surface, the second inlet opening being fluidically connected to the second ink channel opening.

12. The inkjet printer of claim 11, wherein the third layer of the mounting substrate does not include an opening disposed at the surface between the first ink channel opening and the second ink channel opening.

13. The inkjet printer of claim 11, wherein the printhead die further including a supplementary patterned layer adjacent the first layer, wherein a width of an inlet opening of the first ink channel disposed at the second surface is greater than a width of the first ink channel opening at the first surface.

14. The inkjet printer of claim 11, wherein the printhead die further including:

a first supplementary patterned layer adjacent the first layer; and a second supplementary patterned layer adjacent the second layer, wherein a center-to-center spacing between an inlet opening of the first ink channel and an inlet opening of the second ink channel disposed at the second surface is greater than a center-to-center spacing between the first ink channel opening and the second ink channel opening at the first surface.

15. The inkjet printer of claim 11, wherein the mounting substrate comprises multilayer co-fired ceramic.

16. The inkjet printer of claim 15, wherein the co-fired ceramic mounting substrate is insert molded into a plastic member including alignment features for attaching the printhead die.

17. The inkjet printer of claim 11, the printhead die further including:

a first array of drop forming elements that are configured to eject drops of ink through the first array of nozzles; and a second array of drop forming elements that are configured to eject drops of ink through the second array of nozzles.

18. The inkjet printhead of claim 11, the printhead die including a bonding surface for attachment to a die-attach portion of the mounting substrate, wherein an area of the printhead die at the bonding surface is greater than 70% of an area of the die-attach surface of the die-attach portion.

19. An inkjet printer comprising:

an inkjet printhead comprising:

a printhead die including:

a first nozzle array that is configured to be fed with ink by a first ink feed; and a second nozzle array that is configured to be fed with ink by a second ink feed; and a mounting substrate including:

a surface to which the printhead die is attached;

a first layer including a first ink channel having an opening disposed at the surface;

a second layer including a second ink channel having an opening disposed at the surface;

a third layer disposed between the first layer and the second layer, wherein the printhead die is attached to the first layer, the second layer and the third layer, and wherein the first ink channel opening is fluidically connected to the first ink feed, and the second ink channel opening is fluidically connected to the second ink feed;

a fourth layer disposed adjacent the first layer opposite the third layer; and a fifth layer disposed adjacent the second layer opposite the third layer, wherein the printhead die is further attached to the fourth layer and the fifth layer;

a first ink supply that is fluidically connected to the first ink channel opening;

a second ink supply that is fluidically connected to the second ink channel opening; and a media advance system for advancing recording medium into a print region located proximate the first nozzle array and the second nozzle array;

wherein the first ink channel includes one or more connecting features disposed between the fourth layer and the third layer, and the second ink channel includes one or more connecting features disposed between the fifth layer and the third layer.

* * * * *